US006659428B2

(12) United States Patent
Kubota

(10) Patent No.: US 6,659,428 B2
(45) Date of Patent: Dec. 9, 2003

(54) JACK FOR AUTOMOBILE

(75) Inventor: Tatsuo Kubota, Saitama (JP)

(73) Assignee: Rikenseiko Co., Ltd., Kumagaya (JP)

( * ) Notice: Subject to any disclaimer, the term of this patent is extended or adjusted under 35 U.S.C. 154(b) by 0 days.

(21) Appl. No.: 10/103,387

(22) Filed: Mar. 21, 2002

(65) Prior Publication Data

US 2003/0001144 A1 Jan. 2, 2003

(30) Foreign Application Priority Data

Jul. 2, 2001 (JP) ..... 2001-200656

(51) Int. Cl.[7] ..... B66F 3/18

(52) U.S. Cl. ..... 254/103; 254/DIG. 4; 254/100; 254/102

(58) Field of Search ..... 254/103, 102, 254/101, 92, 94, 98, 100, 7 R

(56) References Cited

U.S. PATENT DOCUMENTS 5,085,406 A * 2/1992 Schmaltz ..... 254/103
5,123,629 A * 6/1992 Takeuchi ..... 254/103
5,664,762 A * 9/1997 Rothbauer ..... 254/103
6,145,812 A * 11/2000 Ivanova ..... 254/103

* cited by examiner

*Primary Examiner*—Lee D. Wilson
(74) *Attorney, Agent, or Firm*—Darby & Darby

(57) ABSTRACT

A hollow housing of a screw-type jack is integrally formed by a press. A ram is mounted in the center portion inside this housing in an axial direction to be extendable/contractible in a vertical direction. A drive mechanism mounted in the housing, for extending/contracting this ram in the vertical direction, and in which the housing includes a cylindrical shaft portion protrudingly disposed on a lower part of a side surface of the housing. A drive gear is pivotally and rotatably supported in the cylindrical shaft portion. The housing is made up of a plurality of housing pieces which are vertically divided portions of the housing. The housing pieces are mechanically joined to each other to form the housing. The housing pieces are divided in a vertical direction cutting though the axis of the cylindrical shaft portion. Joining of the housing pieces can use rivets or joining pieces can be swaged over protruding flanges.

12 Claims, 16 Drawing Sheets

JACK FOR AUTOMOBILE

BACKGROUND OF THE INVENTION

1. Field of the Invention

The present invention relates to a screw-type jack mounted mainly on a vehicle such as an automobile, a truck, and so on and used when the vehicle is jacked up for repair and tire change.

2. Description of Related Art

Conventionally, a screw-type jack for high lifting of a mid-load vehicle, a well-known jack called a potbellied jack is used. The potbellied jack has a hollow housing disposed to stand on a base. A cylindrical ram guide and ram are combined in the housing in a telescope style. Two screw shafts are screwed to each other in an axial direction inside the housing to be extendable/contractible in a vertical direction. Such a potbellied jack is described, for example, in Japanese Patent Laid-open Hei 7-196290.

A ram nut attached to a lower end portion of the ram is screwed onto the upper one of the two screw shafts. A bevel gear is fixed to a lower end portion of a lower screw shaft. A drive gear is engaged with the bevel gear. The drive gear is rotated from the outside by an operation handle to extend/contract the ram guide and the ram, whereby a vehicle mounting table disposed on an upper end of the ram is lifted or lowered, depending on the direction of rotation.

The housing of this conventional jack for automobile is formed in such a manner that one portion of a steel pipe expanded to a substantially conical pipe shape using a press. A portion adjacent to the expanded portion in the substantially conic pipe shape is drawn in a rectangular pipe shape. Consequently, forming these shapes using a press is complicated, difficult, and requires a lot of time and labor. Moreover, a forced strength is given to the housing at the time of forming. This method of forming often results in unacceptable shape errors and cracks in the material, which require rejection. Such rejection results in low productivity.

Also, in the above-described conventional jack for automobile, a cylindrical shaft portion for fitting the drive gear therein is welded to a fitting hole disposed in a lower part of a side surface of the housing, and a lower end portion of the housing is welded to a base. This welding consumes a lot of time and labor, and thus increases the production cost. Besides the cost disadvantage, the possibility of insufficient strength resulting from poor welding remains a concern.

In the conventional jack for automobile, an outer circumferential surface of the housing is painted after assembly is finished, with the ram and the ram guide accommodated therein. This painting is complicated and requires a lot of time and labor. In addition, only the outer surface of the housing can be painted. The inside of the housing, other parts, and so on are left unpainted, and therefore, there exists concern about rust prevention.

Poor painting easily happens since grease coated on the bevel gear melts out due to the exposure of the jack to a high-temperature condition before or during painting.

The welding angle of the cylindrical shaft portion relative to the housing is not fixed. A shaft portion of the drive gear directly contacts an inner circumference of the cylindrical shaft portion. Consequently, the drive gear and the periphery of the cylindrical shaft portion in which the drive gear is disposed are given a forced strength to generate heat due to friction heat when the jack is repeatedly lifted and lowered in load tests of the jack. Therefore, there are problems that the life of peripheral parts is shortened, a handle operation requires increased labor, and so on.

The ram and the ram nut of the conventional jack for automobile are separate members fixed to each other by some means such as welding in order to lower production cost. However, since this welding work requires a lot of time and labor, elimination of this operation is considered as one item to be improved.

In order to use the conventional jack for automobile and put its components in their accommodated state, an operation handle having a long grip is used. But there exists a problem that a lot of time is required for lifting and lowering the ram and the ram guide by this operation handle. Therefore, it has been demanded that some method be devised which can lift the ram and the ram guide quickly in a short time to an intended height when they are used and which can also return the ram and the ram guide to their original positions in a short time when they are accommodated after being used.

OBJECTS AND SUMMARY OF THE INVENTION

It is an object of the present invention to provide a screw-type jack for automobile which can solve the various problems described above.

It is a further object of the invention to provide a screw-type jack housing that can be efficiently formed and assembled of a housing and in which streamlined production of the housing at low cost is achieved by eliminating complicated forming work and troublesome welding operations, for the housing, can realize easy and precise surface treatment such as rust prevention to lengthen life and enhance strength, and can realize smooth and easy operation by an operation handle.

It is another object of the present invention to provide a jack for automobile in which a method is devised for a fixing means of a ram and a ram nut to enable its production cost to be further lowered.

It is yet another object of the present invention to provide a jack for automobile in which a method is devised to increase the lifting/lowering speed of a ram when necessary.

In order to achieve the above-described objects, in a screw-type jack for automobile comprising: a base; a hollow and integrated housing provided to stand on this base; a ram mounted in the center portion inside this housing in an axial direction to be extendable/contractible in a vertical direction; and a drive mechanism mounted in the housing, for extending/contracting this ram in the vertical direction, and in which the housing includes a cylindrical shaft portion protrudingly disposed on a lower part of a side surface of the housing, and a drive gear is pivotally and rotatably supported in this cylindrical shaft portion, the present invention defines the housing as constituted of a plurality of housing pieces, namely, vertically divided portions of the housing, wherein the housing pieces are mechanically joined to each other to form the housing. This structure makes it possible to realize easy and uniform forming of the housing by eliminating complicated and difficult forming; furthermore, to realize efficient forming and assembly and streamlined production of the housing at low cost by eliminating troublesome and high-cost welding; and moreover, to enable easy and precise surface treatment such as painting and plating of the housing pieces and so on, thereby lengthening their life and enhancing their strength.

The present invention provides a jack in which the housing is divided in the vertical direction along the axis position of the cylindrical shaft portion, so that forming of the housing pieces is facilitated.

The present invention also provides two-divided portions of the cylindrical shaft portion integrally formed with the housing pieces, so that inefficiency of disposing the cylindrical shaft portion separately as in the conventional art is eliminated and streamlined production is realized.

The present invention provides a housing that is divided into two pieces in the vertical direction. A pair of these housing pieces are formed symmetrically, so that the structure thereof is simplified and the production thereof is facilitated.

The present invention also provides a jack in which each of the housing pieces includes joining pieces along edge portions of the housing piece to extend from these edge portions. When the housing pieces are mechanically joined with each other to form one housing, the joining pieces of the housing pieces are fixed with each other by a rivet, so that welding of the housing pieces is eliminated to realize cost reduction of the housing.

The present invention provides a jack in which the housing piece includes: joining pieces along edge portions of each of the housing portions extend from these edge portions. A connecting piece extends from one or both of the joining pieces. When the housing pieces are mechanically joined with each other to form the housing, the connecting piece is folded to overlappingly fix the joining pieces with each other. In this structure, the housing pieces are fixed to each other by one press work without requiring welding, to further reduce cost.

The present invention provides a jack in which the housing includes a leg piece protruding from a lower end portion of the housing. The leg piece is fixed to the base by a rivet to eliminate welding, so that cost reduction is also realized here.

The present invention also provides a jack in which a bush or a bearing layer is interposed between an inner circumferential surface of the two-divided portions of the cylindrical shaft portion and a shaft portion of the drive gear, so that the drive gear can be rotated smoothly, labor necessary for driving operation is reduced, and heat generation in the periphery of the cylindrical shaft portion is prevented.

In a screw-type jack for automobile comprising: a base; a hollow and integrated housing provided to stand on this base; a ram guide mounted in a center portion inside this housing in an axial direction to be extendable/contractible in a vertical direction; a ram mounted in the ram guide to be extendable/contractible; and a screw shaft for extending/contracting the ram guide and the ram in the vertical direction, and in which the housing includes a cylindrical shaft portion provided protrudingly on a lower part of a side surface of the housing, and a drive gear is pivotally and rotatably supported in this cylindrical shaft portion, the present invention a housing that is constituted of a plurality of housing pieces, namely, vertically divided portions of the housing and both side portions of these housing pieces are mechanically joined with each other to form the housing. This structure makes it possible to realize easy and uniform forming of the housing by eliminating complicated and difficult forming work; and furthermore, to realize efficient forming and assembly and streamlined production of the housing at low cost by eliminating troublesome and high-cost welding. Moreover, easy and precise surface treatment such as painting and plating of the housing pieces and so on is enabled, thereby lengthening their life and enhancing their strength.

The present invention provides a jack in which the ram is constituted of a cylindrical portion and a rum nut. A circumferential groove is formed around an outer circumference of an inserting portion of the ram nut which is to be inserted to the cylindrical portion. After the inserting portion is inserted into the cylindrical portion, an inner surface of the cylindrical portion is bulged out and fixed to the circumferential groove by caulking an outer circumferential portion of the cylindrical portion. Thereby, the ram nut is fixed to the cylindrical portion without welding to realize cost reduction.

The present invention provides a jack in which a quick moving lever is added in order to move a ram quickly in a vertical direction. The quick moving lever is caught in a handle joint of a drive gear and rotates a handle joint with a small rotation radius.

The present invention provides a jack in which a spacer ring is attached between a handle joint of an operation handle and an end portion of an outer surface of the cylindrical shaft portion. The handle joint is attached to the shaft portion of the drive gear to swing freely via a pin, so that backlash of the shaft portion in an axial direction is prevented and the handle joint is free to swing easily.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
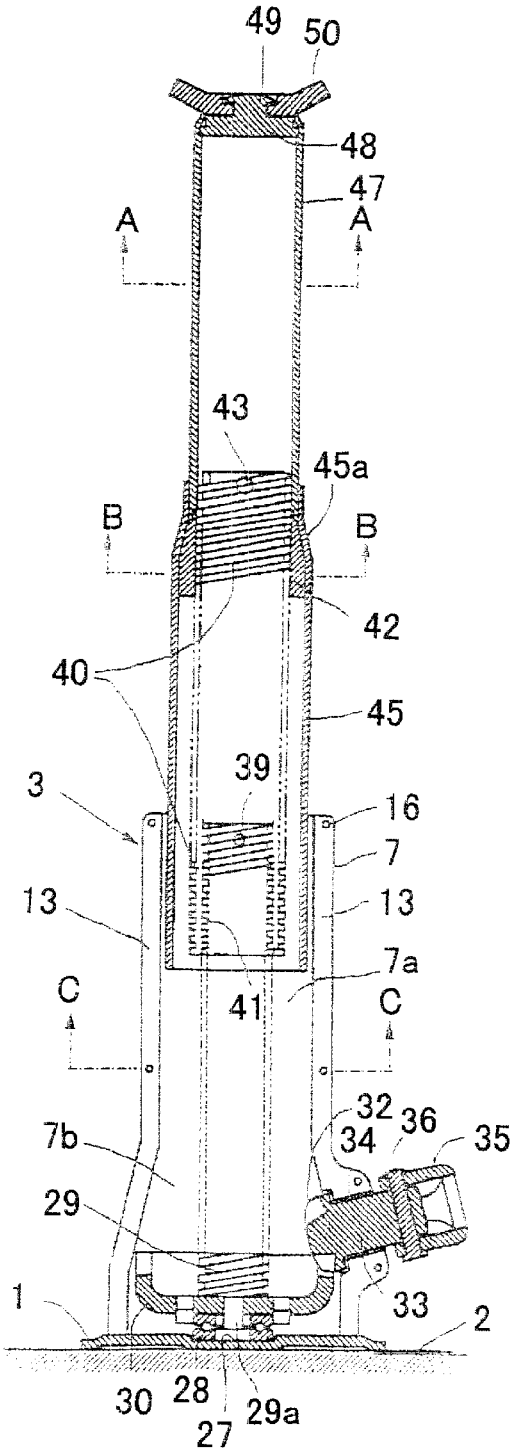
FIG. 1 is a cross sectional view of an embodiment of the present invention, showing its extended state in use.
Figure 2:
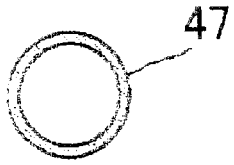
FIG. 2 is a cross sectional view taken along the line A—A in FIG. 1.

Referring FIG. 1 a substantially rectangular base 1 made of a steel plate can be placed on a grounding surface 2. A hollow, cylindrical housing 3 extends upward from the base 1.

The housing 3 has a substantially rectangular pipe-shaped upper half portion. The housing 3 also includes a substantially conic pipe-shaped lower half portion which widens toward its lower part. A cylindrical shaft portion 4 on a lower portion of a side circumferential surface supports a later-described drive gear. The cylindrical shaft portion 4 protrudes slightly upward. A plurality of leg pieces 5 extend outward from a lower end portion of the housing 3.

Figure 7:
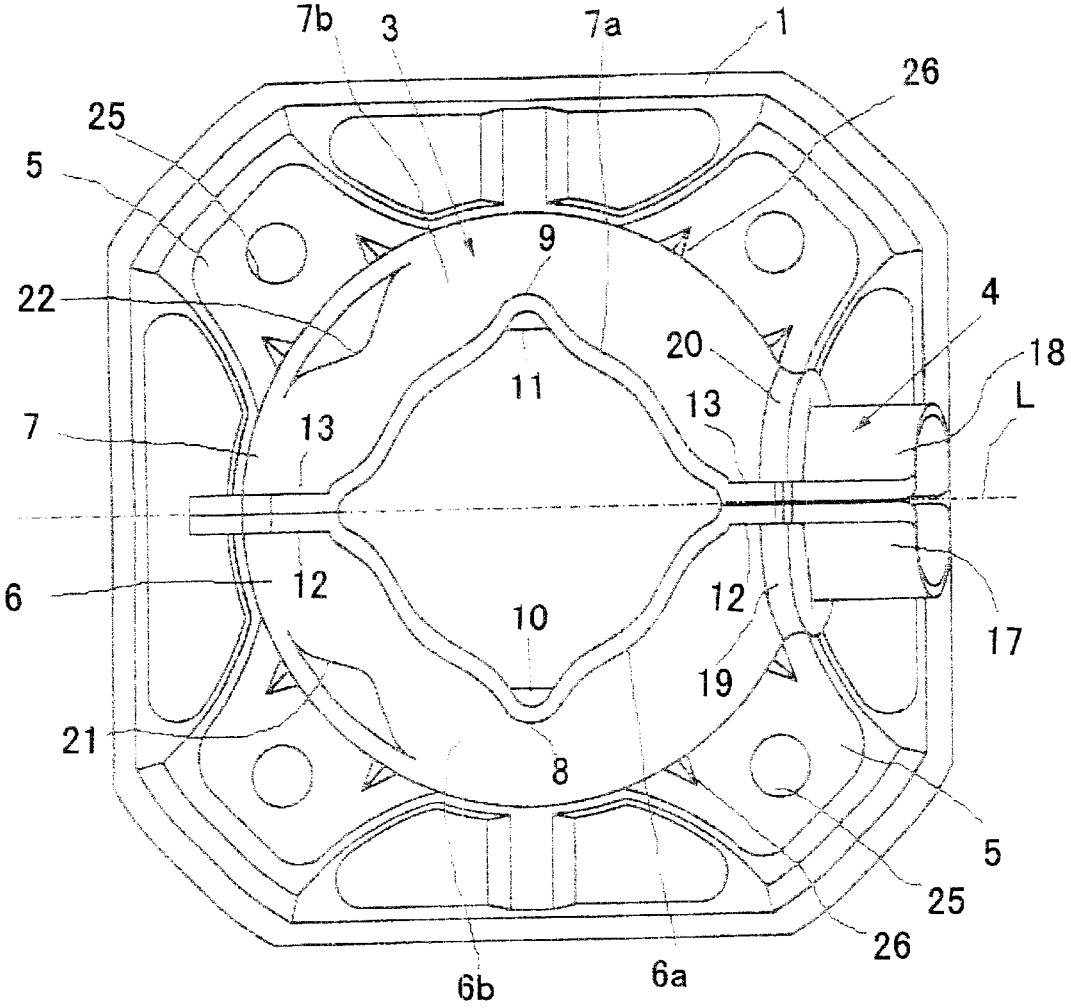
FIG. 7 is a plan view showing the state while the present invention is being assembled, in which a ram and a ram guide are omitted.
Figure 8:
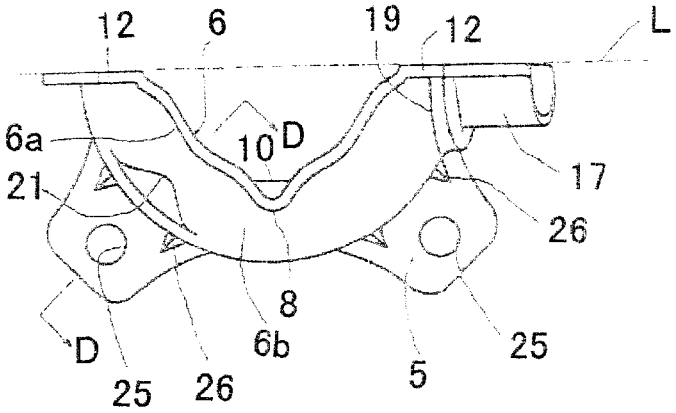
FIG. 8 is a plan view showing one of housing pieces applied to the present invention.
Figure 9:
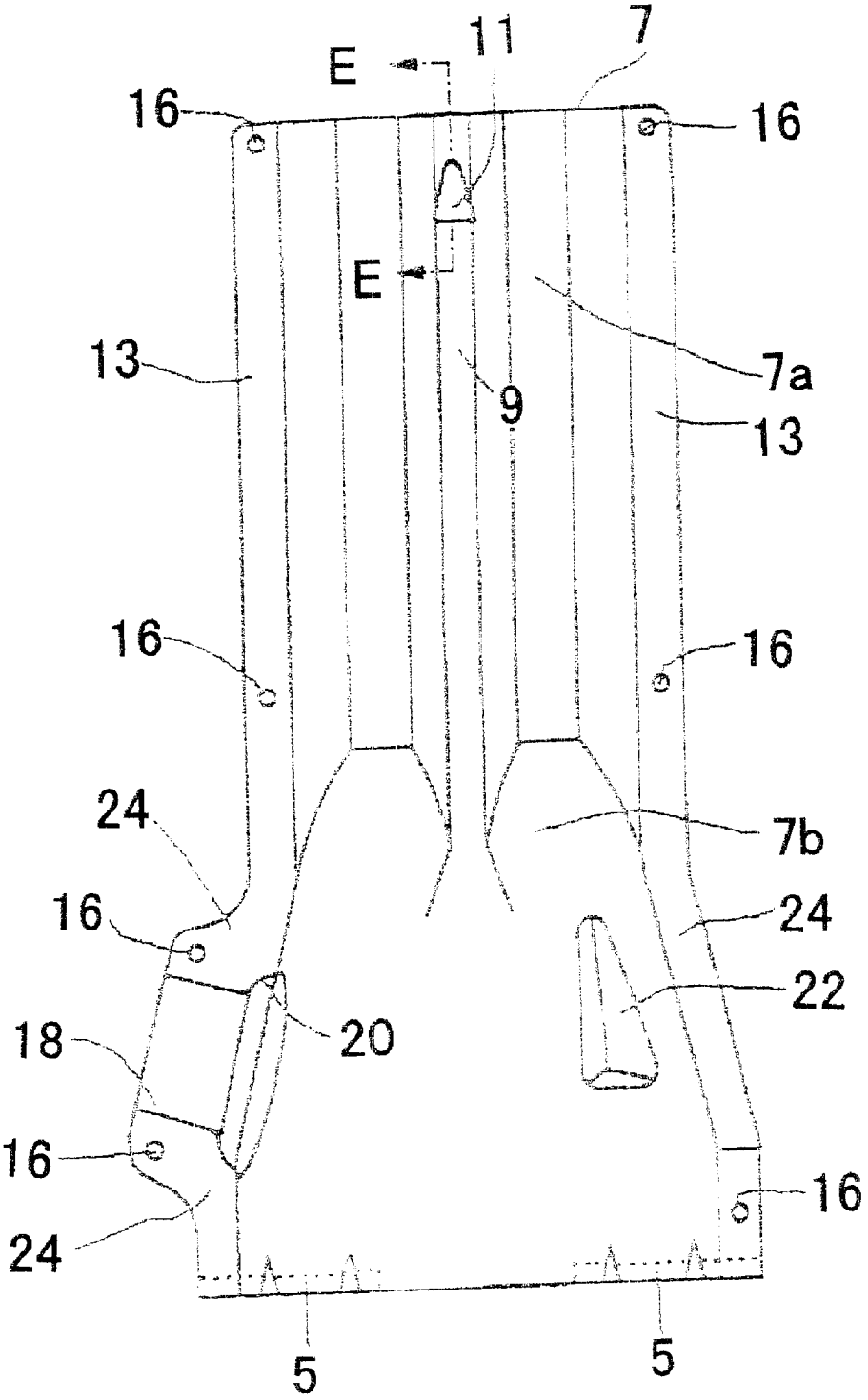
FIG. 9 is a front view showing an inner surface of one of the housing pieces applied to the present invention.

The housing 3 is formed by joining a pair of right and left housing pieces 6, 7 along a joining line L (see FIGS. 7 and 8) passing an axis of the cylindrical shaft portion 4. The right and left housing pieces 6, 7 are formed in substantially the same shape by symmetrically press-forming a medium-thickness steel plate. In this case, the housing 3 can be structured by two or more housing pieces by vertically dividing the housing 3. Thereby, press-forming of the housing pieces is facilitated.

Figure 10:
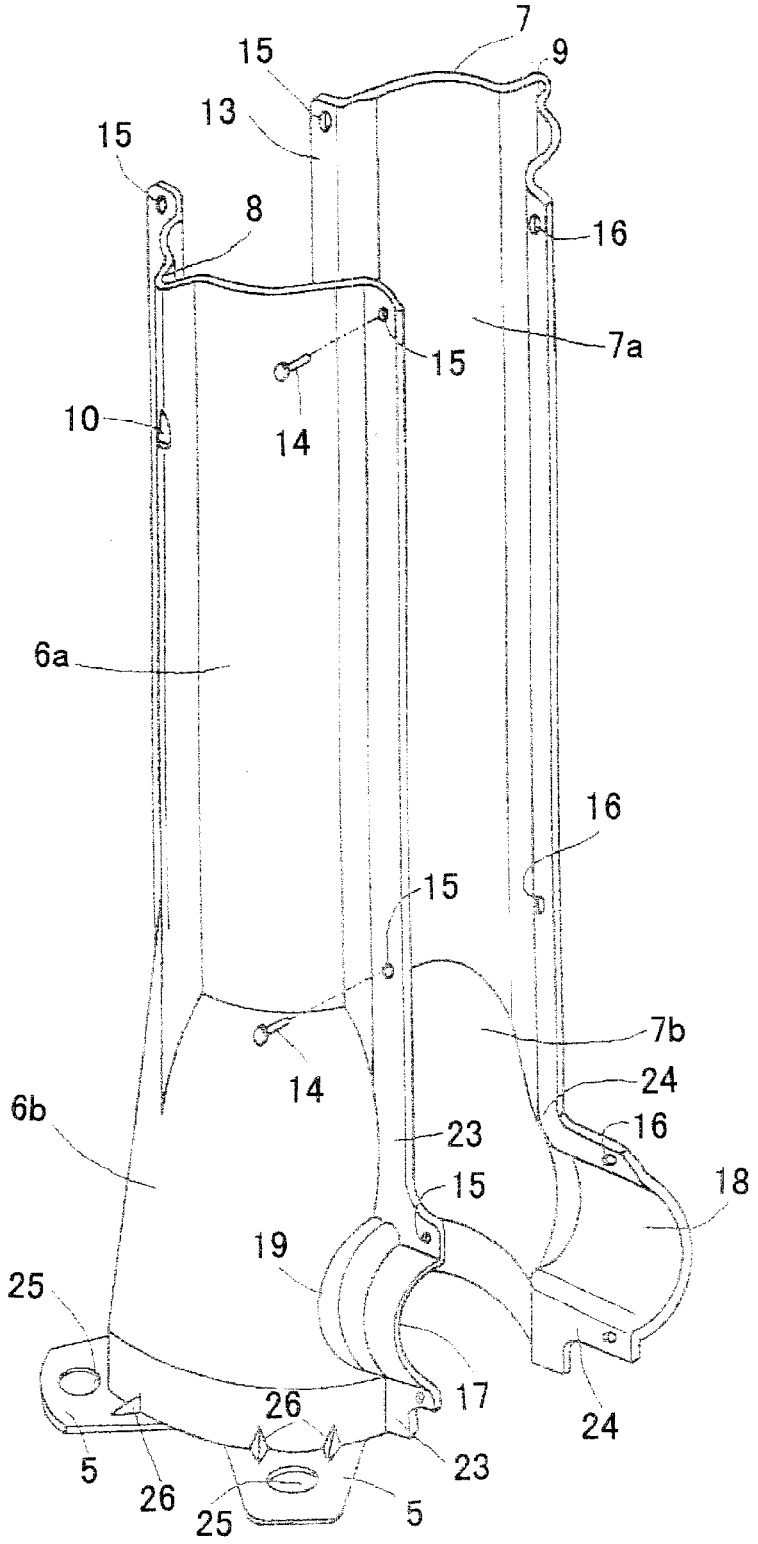
FIG. 10 is a perspective view showing a pair of the housing pieces applied to the present invention.
Figure 11:
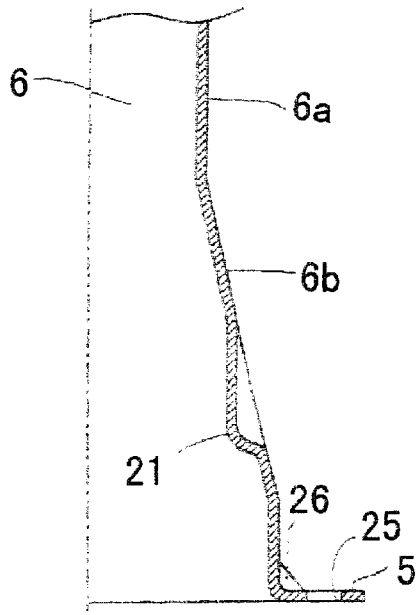
FIG. 11 is a cross sectional view taken along the line D—D in FIG. 8.
Figure 12:
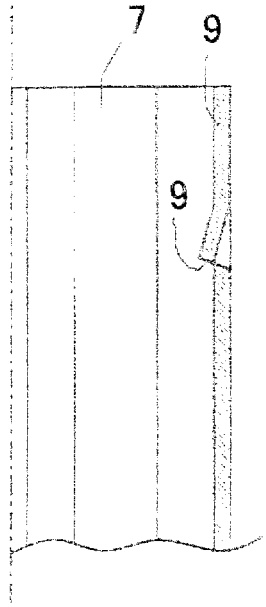
FIG. 12 is a cross sectional view taken along the line E—E in FIG. 9.

As shown in FIG. 10, the housing pieces 6, 7 are formed in a substantially bucket shape widening toward their lower ends. Upper pieces 6*a,* 7*a* corresponding to upper halves thereof have cross sections substantially in a V-shape. Lower pieces 6*b,* 7*b* corresponding to lower halves thereof have substantially semicircular cross sections. The upper pieces 6*a*, 7*a* are formed substantially in the same shape, with convex beads 8, 9 (FIGS. 7 and 10) having substantially outwardly protruding V-shaped or U-shaped cross sections along an axial direction on center portions of circumferential surfaces having substantially semicircular cross sections, as shown in the drawing.

Figure 6:
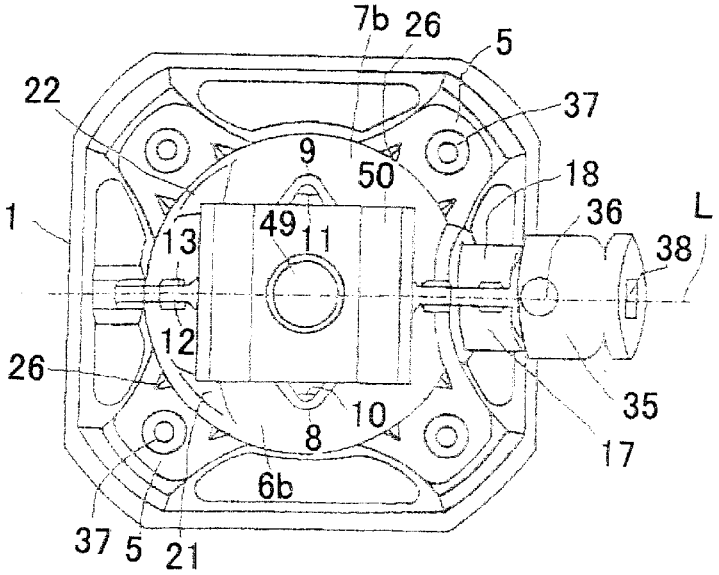
FIG. 6 is a plan view of FIG. 5.

Catching portions 10, 11 (FIGS. 6 and 7) protrude from upper inner surfaces of the beads 8, 9. Projections protruding from a later-described ram guide can be fitted in the catching portions 10, 11. Joining pieces 12, 13 which can be joined with each other are provided along both edges of the upper pieces 6*a*, 7*a* respectively. The joining pieces 12, 13 have a plurality of through holes 15, 16 to receive rivets 14.

The lower pieces 6*b,* 7*b* have substantially the same shape, each formed in a shape obtained by dividing a substantially truncated cone in two in a vertical direction as shown in the drawings. The convex beads 8, 9 extend from the centers of upper circumferential surfaces of the lower pieces 6*b,* 7*b*. Short pipe pieces 17, 18 which constitute the cylindrical shaft portion 4, are formed on a middle bulged portion of its circumferential surface to extend in an upper direction. The short pipe pieces 17, 18 have semicircular cross sections which are obtained by vertically dividing the cylindrical shaft portion 4 into two pieces along the joining line L. Inside the short pipe pieces 17, 18 are fitting stepped portions 19, 20 whose diameters are larger than those of the short pipe pieces 17, 18. A shaft portion of a later-described drive gear is rotatably accommodated inside the joined short pipe pieces 17, 18. Catching projections 21, 22 protrude from inner circumferential surfaces of the lower pieces 6*b,* 7*b* opposite the short pipe pieces 17, 18. The catching projections 21, 22 are disposed directly above a later-described bevel gear to permit fitting the catching projections 21, 22 in the lower pieces 6*b,* 7*b*.

Connecting pieces 23, 24, having substantially the same shape as the joining pieces 12, 13, are disposed along both edges of the lower pieces 6*b,* 7*b*. connecting pieces 23, 24 can be joined to each other. A plurality of through holes 15, 16 in the connecting pieces 23, 24 permit insertion of the rivets 14.

Through holes 25 in the leg portions 5 permit the insertion of rivets 37 therethrough. This enables the leg portions 5 to be fixed to the base 1 using the rivets 37. Reinforcing beads 26 are formed on folded portions of the leg pieces 5. A concave portion 27 is formed on the center part of an inner surface of the base 1. A thrust bearing 28 is accommodated in the concave portion 27. A lower end portion of a first screw shaft 29 is rotatably supported in the thrust bearing 28. A substantially bowl-shaped bevel gear 30 is fixed to a small-diameter shaft portion 29*a* at the lower end portion of the first screw shaft 29. The bevel gear 30 rotates with the first screw shaft 29. A bottom surface of the bevel gear is seated on an inner race of the thrust bearing 28.

A connecting pin 31 (FIG. 5) is attached to the small-diameter shaft portion 29*a* to retain the bevel gear 30 on the small-diameter shaft 29*a*. The catching projections 21, 22 are disposed directly above a rotation area of the bevel gear 30 so that they can be fitted in the bevel gear 30, whereby the bevel gear 30 and the first screw shaft 29 are prevented from moving upward and coming off:

A drive gear 32 is affixed to an inner end of a shaft portion 33. The drive gear 32 engages the bevel gear 30. A boss of the drive gear 32 is fitted in the fitting stepped portions 19, 20. The drive gear 32 is integrally formed with a shaft portion 33. The shaft portion 33 is supported rotatably inside the short pipe pieces 17, 18 via a bush 34. An end portion of the shaft portion 33 projects outward from the short pipe pieces 17, 18. A handle joint 35 is connected to this projecting portion via a pin 36 to permit the handle joint to swing freely. An end portion of an outer surface of the handle joint 35 includes a fitting groove 38 (FIG. 6) into which an end portion of an operation handle (not shown) can be inserted. The fitting groove 38 is shown with a rectangular cross section for mating with a rectangular end of the operation handle. Other shapes may be adopted for the fitting groove 38 and the mating operation handle.

The first screw shaft 29 is a steel rod a little shorter than the height of the housing 3. The first screw shaft 29 has a male screw portion on its entire outer circumferential surface. A stopper pin 39 (FIG. 1) protrudes from an upper end portion of the male screw portion. The stopper pin 39 is positioned on a surface substantially equal in height with an outer diameter of the male screw portion of the first screw shaft 29 so that it can engage a female potion 41 on a lower end of an inner surface of a second screw shaft 40 to restrict the lifting position of the second screw shaft 40 when they are caught by each other.

The second screw shaft 40, which is substantially equal in length to the first screw shaft 29, is made of a steel pipe with a relatively large diameter. The second screw shaft 40 has a male screw portion over its entire outer circumferential surface. The female screw portion 41, which can be screwed to the male screw portion of the first screw shaft 29, is formed on a lower end portion of an inner surface thereof. A ram nut 42 is screwed to the male screw portion of the second screw shaft 40, so that the ram nut 42 can vertically move along the male screw portion. When the ram nut 42 reaches its highest position, it is stopped by a stopper pin 43 which is attached in an upper end portion of the second screw shaft 40. This limits the upward movement of the ram nut 42. In this case, the stopper pin 43 is positioned in a surface substantially equal in height to the outer diameter of the male screw portion of the second screw shaft 40. The ram nut 42, which has a female screw portion, which can be screwed to the male screw portion of the second screw shaft 40, has an external shape of a substantially truncated cone. The ram nut 42 has a plurality of convex beads 44 (FIG. 3) formed on a tapered outer circumferential surface thereof in an axial direction, so that the ram nut 42 can be caught by a ram guide 45 when the ram nut 42 reaches its highest position.

Figure 3:
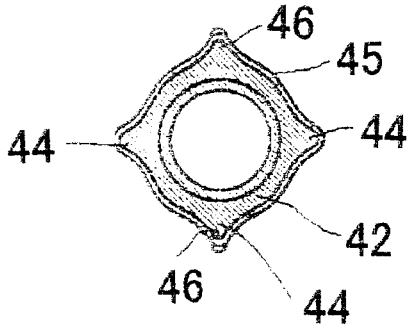
FIG. 3 is a cross sectional view taken along the line B—B in FIG. 1.
Figure 4:
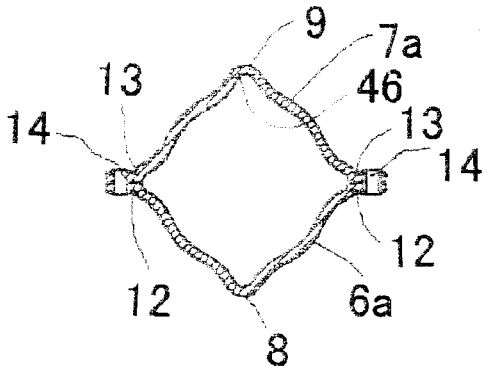
FIG. 4 is a cross sectional view taken along the line C—C in FIG. 1.

The ram guide 45 is made of a steel pipe substantially equal in length to the first screw shaft 29. The ram guide 45 has a substantially square cross section as shown in FIG. 3 and FIG. 4, with a shape similar to the external appearance of the ram nut 42 or the shape of an inner surfaces of the joined housing pieces 6, 7. The ram guide 45 has a plurality of fitting grooves 46 on its inner surface into which the convex beads 44 can be fitted.

A tapered diameter-reducing portion 45*a* is disposed in an upper end portion of the ram guide 45. The ram nut 42 can be caught by an inner surface of the diameter-reducing portion 45*a* to permit the ram guide 45 to move with the ram nut 42. Projections (not shown) which can be fitted in the aforesaid catching portions 10, 11 are formed on a circumferential surface of a lower end portion of the ram guide 45, to limit the upward motion of the ram guide 45.

A lower end portion of a ram 47 is welded to the ram nut 42. The ram 47 is made of a steel pipe which can be accommodated in the ram guide 45. The ram 47 is shorter than the ram guide 45 by the length of the ram nut 42.

A top plate 48 is connected to an upper end portion of the ram 47 by caulking. A vehicle mounting table 50 is connected by caulking to a fitting shaft 49 protruding upward from the top plate 48. The top plate 48 may alternatively be connected using a bolt or a screw instead of being connected by caulking.

The mechanical joining means described above for joining the housing pieces 6, 7 with each other and fixing the housing 3 to the base 1 can be substituted for by other joining means without departing from the spirit and scope of the invention. For example both of the members maybe fitted to each other and connected by pressure or by fixing them to each other by a screw, and so on.

In producing thus-structured jack for automobile, an iron plate is press-formed to produce a pair of the housing pieces 6, 7, the housing 3 is formed in a cylindrical shape by joining the housing pieces 6, 7. Thereafter, the base 1, the ram 47, the ram guide 45, and so on are assembled together. Surface treatment such as painting and plating of the components is performed as described later before the assembly of the base 1, the ram 47, the ram guide 45, and so on is combined in the housing 3. That is, the surface treatment is performed when the parts can be handled easily. In other words, the surface treatment of each of the components is separately or synchronously performed before being assembled in the housing 3, and this assembly is combined in the housing 3 after each of the components undergo the surface treatment.

This makes it possible to perform the surface treatment for both of the outer and inner surfaces of each of the components and take precautionary means to prevent oil and fat content from adhering to the treated surfaces. This permits realization of easy, sure, and precise surface treatment compared with a conventional producing method in which the surface treatment is performed after the components is combined in the cylindrical housing 3. In this manner, an anti-corrosive property thereof is improved and the life of the jack is lengthened.

The housing pieces 6, 7 are formed symmetrically by press-forming a steel plate. This can be done easily, quickly, and uniformly compared with a conventional press-forming in which one portion of a cylindrical steel pipe is formed in a rectangular pipe shape and this portion in a rectangular pipe shape is formed to bulge to a substantially conic pipe.

The housing pieces 6, 7 are portions of the housing divided in the vertical direction along the joining line L passing the axis of the cylindrical shaft portion 4. Thus the housing pieces 6, 7 are easily and uniformly formed compared with a device that is divided in the vertical direction along another line and the cylindrical shaft portion 4 is formed separately.

The housing pieces 6, 7 after being press-formed, which are shown in FIG. 10, are formed to be in a bucket shape, with the upper half portion thereof having a substantially V-shaped cross section and a substantially semicircular shaped lower half portion.

In addition, the short pipe pieces 17, 18, which constitute the cylindrical shaft portion 4, are integrally formed with the housing pieces 6, 7, so that the time/labor and the number of parts is reduced and the cylindrical shaft portion 4 is produced easily and at low cost, compared with a conventional production method in which the cylindrical shaft portion 4 is produced separately and welded to a forming hole of the housing.

The aforesaid assembly is combined in the housing 3 after each of the components undergoes surface treatment, and the actual processes will be described as follows.

First, when the housing 3 is to be assembled, a pair of the right and left housing pieces 6, 7 are disposed facing each other as shown in FIG. 10 with the through holes 15, 16 in the joining pieces 12, 13, 23, 24 aligned with each other. The rivets 14 are inserted through the through holes 15, 16. The rivets 14 are struck, so that the housing pieces 6, 7 are riveted to each other. The upper half portion of thus assembled housing 3 has a cross section in a substantially square shape as shown in FIG. 3. Catching grooves in a substantially similar shape to the convex beads 8, 9 are formed in four corners of its inner circumferential surface. A cylindrical space is formed opposite the short pipe pieces 17, 18 on the lower part of the housing 3. A short cylindrical space is formed opposite the fitting stepped portions 19, 20.

Then, the bush 34 is inserted from the inside of the housing 3 into the cylindrical space. Next, the drive gear 32 is inserted into the cylindrical space from the inside of the housing 3. The shaft portion 33 of the drive gear 32 is inserted into the bush 34. The handle joint 35 is fitted to the projecting portion of the shaft portion 33, where they are connected with each other via the pin 36 free to swing freely.

The ram nut 42 is welded to the lower end portion of the ram 47 before the top plate 48 is attached thereto. An assembly of the second screw shaft 40 and the first screw shaft 29 is inserted from an upper opening portion of the ram 47. The ram guide 45 is inserted from the top of the ram 47, and the ram guide 45 is caught by the ram nut 42.

To specifically explain the assembly of the first and second screw shafts 29, 40, the pin 43 is inserted into the upper end portion of the second screw shaft 40. The first screw shaft 29 is screwed onto the screw portion 41 in the lower end portion of the second screw shaft 40. The first and second screw shafts are caught with each other via the pin 39.

Then, the bevel gear 30 is attached to the small-diameter shaft portion 29*a* in the lower end of the first screw shaft 29, and the connecting pin 31 is inserted directly under the bevel gear 30 to connect and integrate them.

In this way, the ram 47 to which the top plate 48 is not yet attached, the ram guide 45, the first and second screw shafts 29, 40, the bevel gear 30, and so on are integrally assembled, and this assembly is combined in the housing 3.

Specifically, the base 1 is placed on a work table. The bearing 28 is inserted into its concave portion 27. The small-diameter shaft portion 29*a* of the aforesaid assembly is inserted into a center hole of the bearing 28, so that this assembly remains in a standing state.

Next, the housing 3 is placed from above over this assembly with the through holes 25 of the leg pieces 5 matched with predetermined positions of the base 1. The rivets 37 are inserted into the through holes 25, these rivets 37 are struck, so that the leg pieces 5 are riveted to the base 1. In this way, conventional welding is not used for fixing the housing 3 to the base 1, so that they can be surely and easily connected at low cost. Thereafter, after the top plate 48 is attached to the upper end portion of the ram 47 by caulking and the vehicle mounting table 50 is attached to its fitting shaft 49 by caulking, the assembly work is finished.

Figure 5:
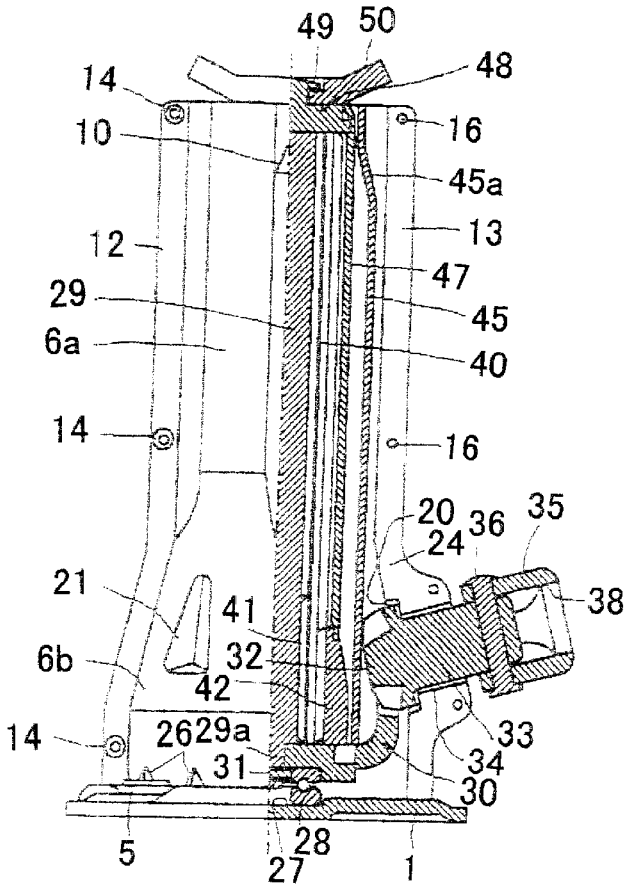
FIG. 5 is a fragmentary cross sectional view of the embodiment of the present invention, showing its contracted state when it is not in use.

Thus assembled jack for automobile contracts to a small size as shown in FIG. 5 when it is not in use. At this time, the second screw shaft 40, the ram 47, and the ram guide 45 are contracted to the minimum length and accommodated in the housing 3 in a triple cylinder state. The ram nut 42 is placed at the lowest position and the vehicle mounting table 50 is positioned directly above the upper end portion of the housing 3.

In this state, when the jack for automobile is to be used for jacking up a vehicle, the jack for automobile is positioned directly under a jack point of the vehicle, for example, a jack point around a tire housing, the end portion of the operation handle (not shown) is inserted in the fitting groove 38 thereof and the handle is rotated around an axis of a shaft. This operation rotates the drive gear 32 and, as a result, rotates the bevel bear 30 engaged with the drive gear 32. The first screw shaft 29, integral with the bevel gear 30, is also rotated.

This causes the second screw shaft 40 to move upward along the first screw shaft 29 via the female screw portion 41. When the upper end potion of the female screw portion 41 contacts the pin 39 of the first screw shaft 29, in other words, when the second screw shaft 40 is extended to its full stroke, the upward movement of the second screw shaft 40 is stopped so that it rotates idly in this position.

In accordance with the idle rotation of the second screw shaft 40, the ram nut 42 moves upward along the male screw portion of the second screw shaft 40 without rotating and the diameter-reducing portion 45*a* is caught by the rain nut 42 to move the ram guide 45 upward. The upward movement of the ram nut 42 causes the ram 47 fixed to the ram nut 42 to move upward.

At this time, the ram nut 42 is fitted in the inner surface of the ram guide 45 and the outer surface of the ram guide 45 is fitted in the inner surface of the housing 3 so that the moving posture thereof is stabilized. This state is shown in FIG. 3 and FIG. 4.

When the ram 47 moves upward, the vehicle mounting table 50 fits in the jack point around the tire housing of the vehicle to jack up the vehicle.

In this way, when the ram nut 42 is moved to the highest position of the second screw shaft 40, the upper end portion of the ram nut 42 is caught by the pin 43 so that its upward movement is restricted.

At this time, the projections (not shown) on the lower end portion of the ram guide 45 are caught by the catching portions 10, 11 so that the upward moving position of the ram guide 45 is restricted.

Then, the ram 47 is extended to its full stroke to cause the vehicle mounting table 50 on the upper end portion of the ram 47 to reach its highest position so that the periphery of the tire housing of the vehicle is jacked up to a predetermined height to enable a tire to be changed. This, extended state is shown in FIG. 1.

After the jack for automobile is used, the operation handle is rotated n the reverse direction to cause the drive gear 32 and the bevel gear 30 to reversely rotate so that the first screw shaft 29 is reversely rotated.

This causes the second screw shaft 40 to rotate reversely and to move downward along the first screw shaft 29 so that the ram nut 42 and the ram guide 45 move with it until the second screw shaft 40 and the ram guide 45 are accommodated in the housing 3.

As described above, in this embodiment, a drive means 51 mounted in the housing 3 for vertically moving the ram 47 is composed of the drive gear 32, the bevel gear 30 engaged with the drive gear 32, the first screw shaft 29 fixed to the bevel gear 30, the second screw shaft 40 screwed to the first screw shaft 29 in an axial direction, and the ram guide 45. However, the drive means 51 is not limited to this embodiment. Only one screw shaft may be used. When only one screw shaft is used, the ram guide 45 may sometimes be omitted. What is important is that any drive means may be used as long as it causes the ram to move vertically by rotating the drive gear 37 which is pivotally and rotatably supported in the cylindrical shaft portion 4.

After being accommodated, the ram nut 42 is positioned at the upper end portion of the second screw shaft 40 which corresponds to the upper end portion of the housing 3.

Thereafter, when rotation of the operation handle is reversed, the second screw shaft 40 rotates idly in its accommodated position to cause the ram nut 42 to move downward along the second screw shaft 40 without rotating and the ram 47 and the ram guide 45 rotate with it.

At this time, the ram nut 42 is fitted in the inner surface of the ram guide 45 and the outer surface of the ram guide 45 is fitted in the inner surface of the housing 3 so that the moving posture thereof is stabilized.

When the vehicle mounting table 50 is moved away from the jack-up point of the vehicle and the ram 47 and the ram guide 45 are returned to their original positions, the jack for automobile can be taken out from under the vehicle.

The rotation of the drive gear 32, when the jack for automobile is used, causes the periphery of the shaft portion 33 to generate heat due to contact friction between the shaft portion 33 and the bush 34. However, a flat and smooth contact surface of the bush 34 reduces the contact friction to reduce the heat generation, so that a normal usage state is maintained, and thereby, the life of the shaft portion 33 is lengthened compared with a case when the shaft portion 33 directly contacts the inner surfaces of the short pipe pieces 17, 18.

The bush 34 can be omitted when thin bearing layers made of metal or synthetic resin is coated on the respective inner surfaces of the short pipe pieces 17, 18 in which the bush 34 is attached and on the respective inner surfaces of the fitting stepped portions 19, 20, in the above-described embodiment. In this case, the bearing layers may overlap the aforesaid surface treatment layers, or the beating layers may be directly coated without the surface treatment layers. The former case facilitates the forming of the bearing layers. The latter case enhances the fixability of the bearing layers, so that detachment and abrasion of the bearing layers due to the elapse of time can be prevented.

The housing pieces 6, 7, which are made of metal plates in the above-described embodiment, may be made of cast iron, by die-casting, or of synthetic resin. This makes it possible to form the housing pieces 6, 7 easily and at low cost.

Figure 13:
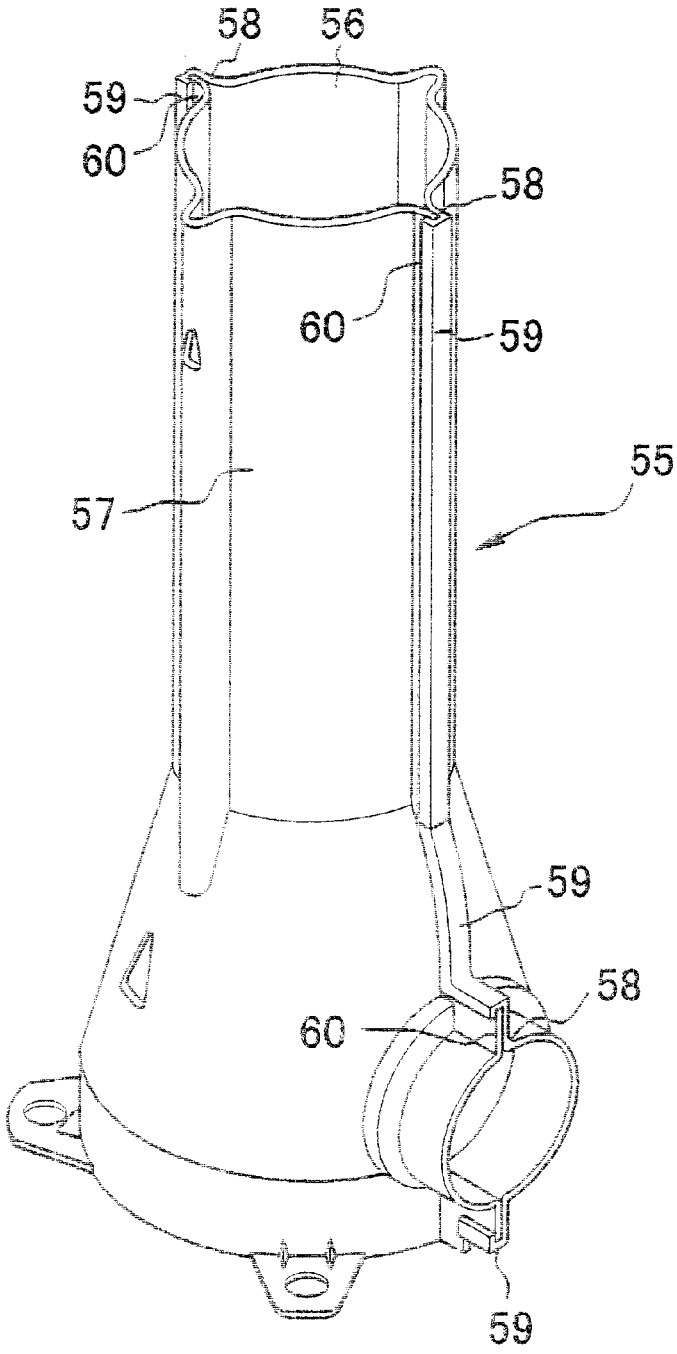
FIG. 13 is a perspective view showing another embodiment of the housing.
Figure 14:
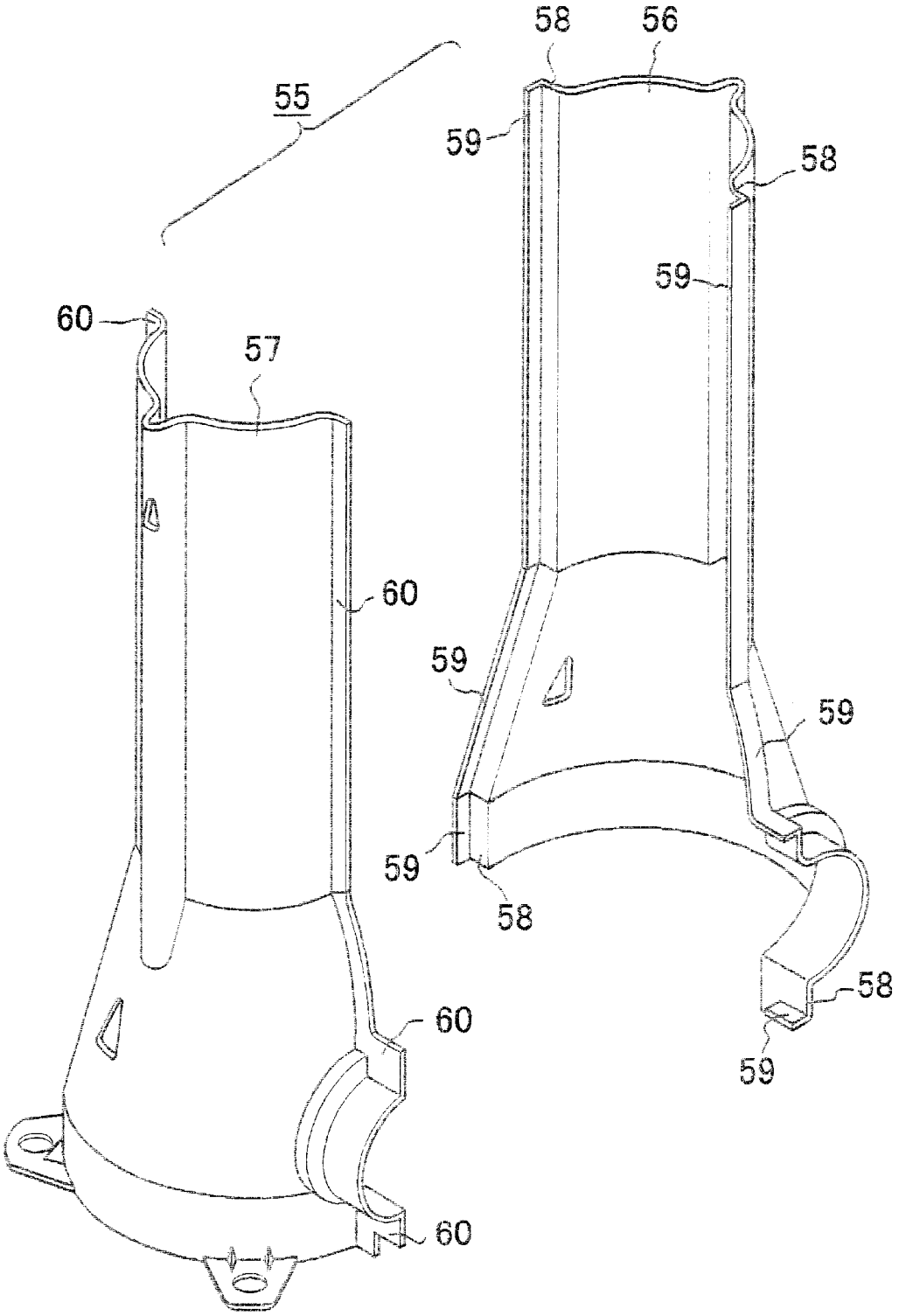
FIG. 14 is an exploded perspective view before the housing pieces of a housing shown in FIG. 13 are joined with each other.
Figure 15:
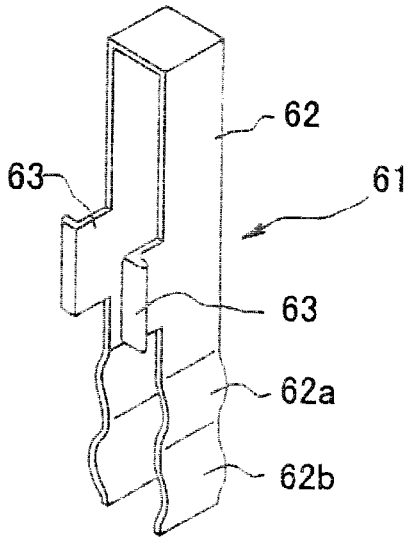
FIG. 15 is a perspective view showing a quick moving lever as one embodiment of a quick moving means.
Figure 16:
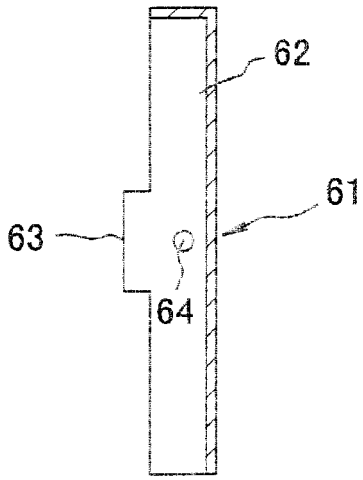
FIG. 16 is a vertical sectional view of the quick moving lever shown in FIG. 15.
Figure 17:
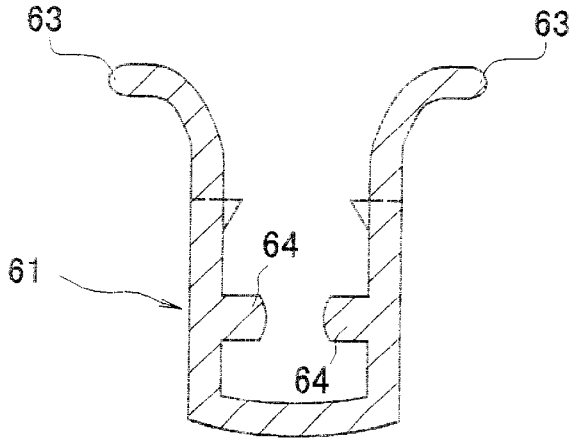
FIG. 17 is an enlarged horizontal sectional view of the quick moving lever shown in FIG. 15 taken along portions of resilient catching pieces.

FIG. 13 and FIG. 14 show another embodiment of the housing, in which a housing 55 is made up of housing pieces 56, 57. The housing pieces 56, 57 consist of two vertically divided portions of the housing 55 as in the aforesaid embodiment. However, this embodiment is different from the aforesaid embodiment in that the forming method of the housing 55 in which the housing pieces 56, 57 are not joined to each other by rivets. Instead, joining pieces 58 of one housing piece 56 overlap joining pieces 60 of the other housing piece 57. A plurality of connecting pieces 59 provided to further protrude from the joining pieces 58 are folded to catch the joining pieces 60 of the other housing piece 57. Thereby the housing pieces 56, 57 are joined to each other, This structure makes it possible to join the housing pieces 56, 57 with each other in one operation using a pressing machine, which offers the advantage of reduced cost, compared with a case when the housing pieces 56, 57 are joined with each other by riveting using a plurality of rivets.

The connecting pieces 59 maybe provided to all of the joining pieces 58, or they may be provided only to portions joined by the rivets as described in he aforesaid embodiment. The connecting pieces 59 may be provided to the other connecting pieces 60 or may be provided alternately to the joining pieces 58, 60. Moreover, joining by rivets may also be employed together with the use of joining pieces 58, 60.

Figure 18:
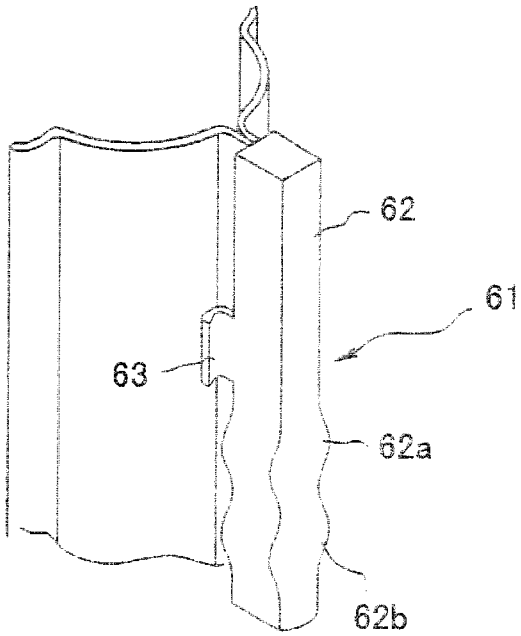
FIG. 18 is an explanatory view for explaining how the quick lever shown in FIG. 15 is accommodated when it is not in use.
Figure 19:
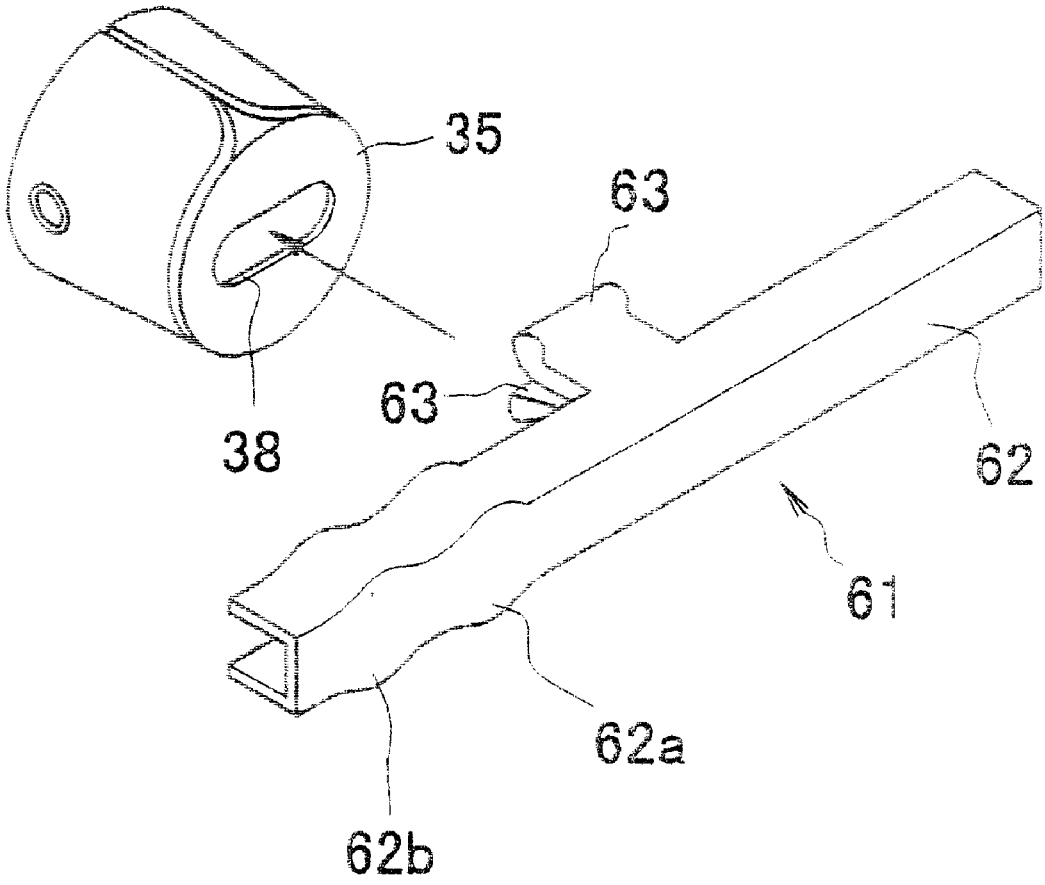
FIG. 19 is an explanatory view for explaining how the quick moving lever shown in FIG. 15 is used.

FIG. 15 to FIG. 19 show a quick moving means of the ram. In the drawings, the quick moving means consists of a flexible synthetic resin quick moving lever 61 made of, for example, PE. The quick moving lever 61 is composed of a grip portion 62 having a U-shaped cross section and resilient catching pieces 63, 63 protruding from the substantially central portion of the grip portion 62. As shown in FIG. 19, the resilient catching pieces 63, 63 are inserted in a fitting groove 38 in the handle joint 35. The resilient catching pieces 63, 63 are resiliently urged outward to catch in the fitting groove 38. The handle joint 35 is attached to the shaft portion of the drive gear. The grip portion 62 is gripped by a hand to rotate the handle joint 35, which results in quick rotation of the not-shown drive gear.

This operation rotates the drive gear more quickly than in a case when it is rotated using an operation handle since the rotation radius is small and is easily operated. Consequently, the ram guide and the ram can be lifted/lowered more quickly. After the vehicle mounting table contacts the jack point of the vehicle, it is necessary to use the operation handle to apply the increased torque needed to raise the vehicle. The quick moving lever 61 working as a quick moving means is also effective while returning the components to their original stowed positions after usage. A pair of catching projections 64, 64 are provided on the inner surface of portions where the resilient catching pieces 63, 63 are formed. As shown in FIG. 18, these catching projections 64, 64 are fitted in not-shown catching holes in the joining pieces or the connecting pieces of the housing. The quick moving lever 61 is kept in this state when it is not used. Note that bulging portions 62*a*, 62*b* formed on one side deviated from the center portion of the grip portion 62 make the grip portion easy to grip during use.

Figure 20:
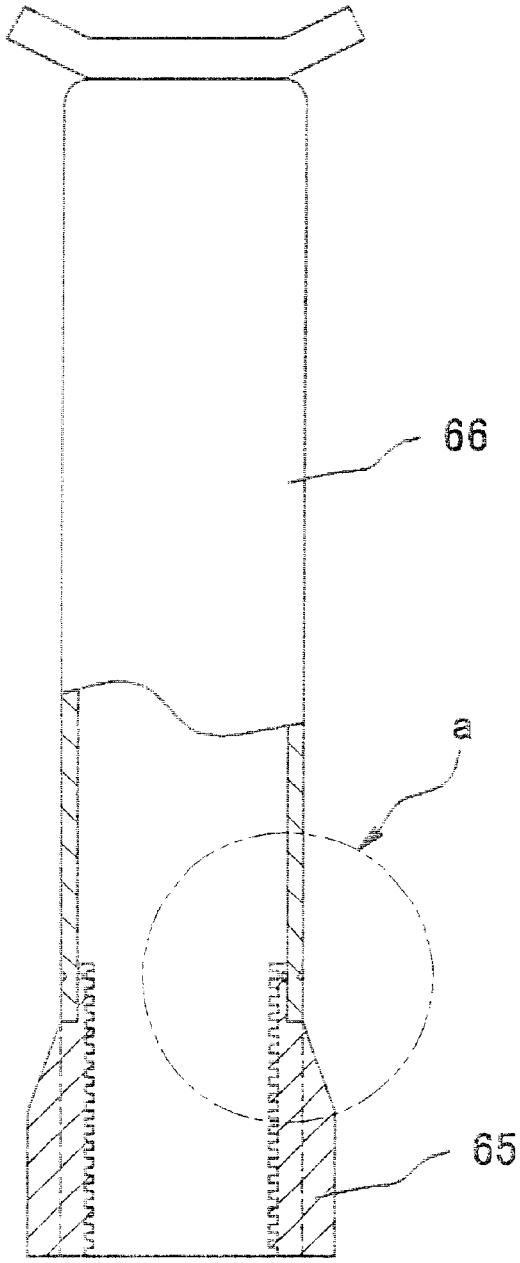
FIG. 20 is a fragmentary cross sectional view showing a fixing means of the ram and the ram nut.
Figure 21:
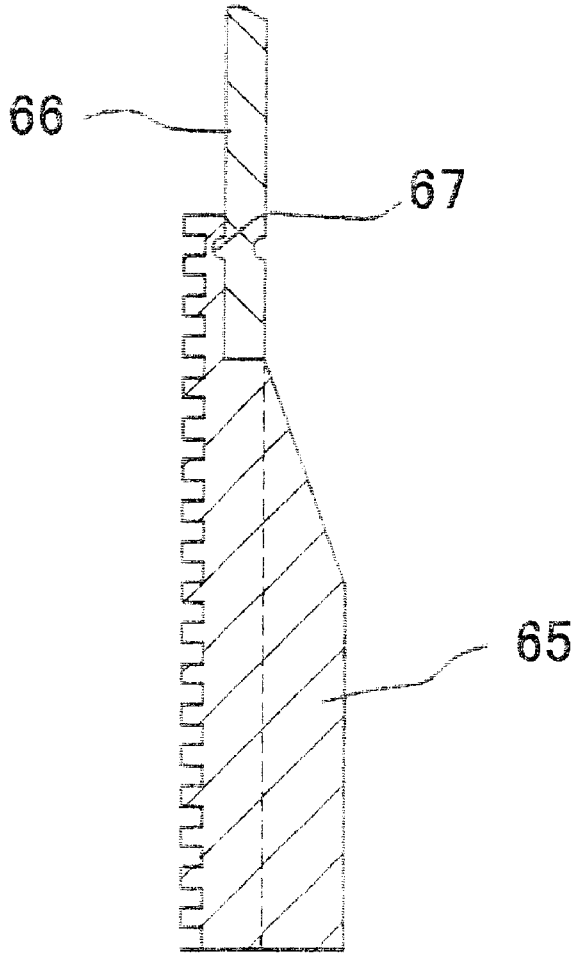
FIG. 21 is an enlarged cross sectional view showing a portion of a in FIG. 20.

FIG. 20 and FIG. 21 show a fixing means for the ram and the ram nut. A circumferential groove 67 is formed in a fitting portion 65*a*, which is inserted in the ram 66, of the ram nut 65. An outer circumferential portion of the ram 66 corresponding to this circumferential groove 67 is caulked by pressure to cause an inner circumference of the ram 66 to bulge inwardly and to be pushed into the circumferential groove 67 of the ram nut 65. This fixedly connects together the ram 66 and the ram nut 65. This structure brings about the advantage of reducing production cost compared with a case when the ram 66 and the ram nut 65 are welded to be fixed with each other.

Figure 22:
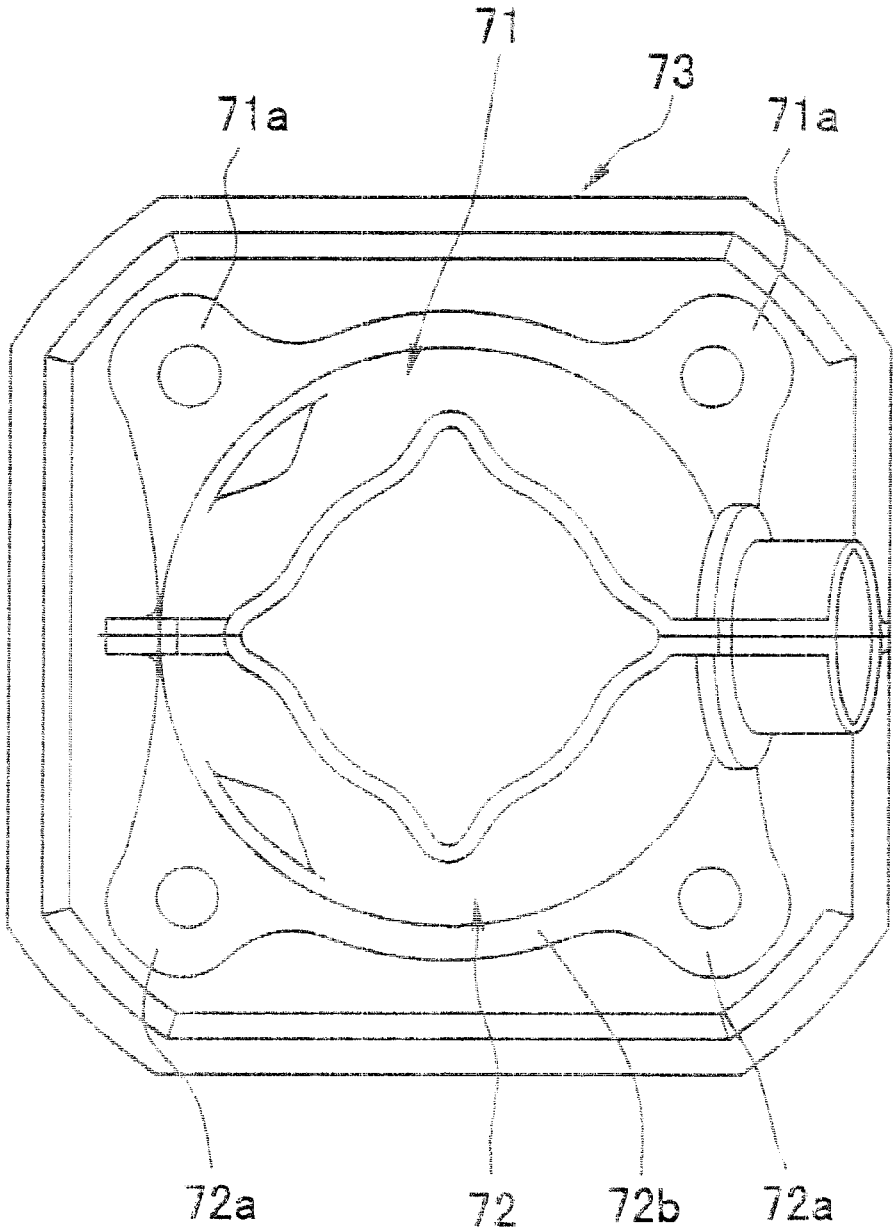
FIG. 22 is a plan view showing another embodiment of a reinforcing means of a leg piece of the housing piece.

FIG. 22 shows another embodiment of the reinforcing means of the leg pieces of each of the housing pieces. The reinforcing beads, which are provided in the aforesaid embodiment, are not included on leg pieces 71*a*, 71*a*, 72*a*, 72*a* of the housing pieces 71, 72 constituting the housing 70. Instead, a flange portion 71*b* connect the leg pieces 71*a*, 71*a* of the housing piece 72, and a flange portion 72*b* connect the leg pieces 72*a*, 72*a* of the housing piece 72. The reference numeral 73 denotes a base.

This structure brings about an advantage that the reinforcing means can be formed more easily than in a case when the reinforcing beads are formed even though they are formed by press work in both cases.

Figure 23:
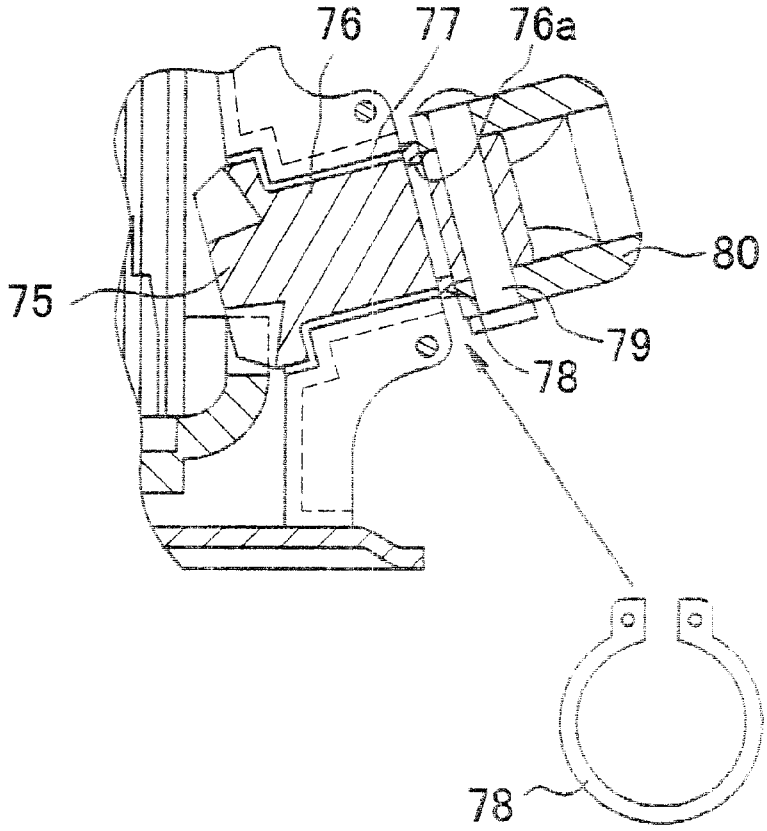
FIG. 23 is an enlarged cross sectional view showing another embodiment of a portion where a handle joint is provided.

FIG. 23 shows another embodiment of attaching a drive gear to a cylindrical shaft portion. A circumferential groove 76*a* is formed in a portion of a shaft portion 76 of the drive gear 75. This portion matches the position of an end portion of an outer surface of the cylindrical shaft portion 77. A spacer ring 78 is fitted in this circumferential groove 76*a* to contact the end portion of the outer surface of the cylindrical shaft portion 77.

This structure eliminates backlash of the shaft portion 76 in an axial direction and enables a handle joint 80, which is attached to the shaft portion 76 via a pin 79 to swing freely, to swing more smoothly so that an advantage of improving operability of the operation handle is brought about.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A screw-type jack for automobile, comprising:

a base;

a hollow and integrated housing on said base;

a ram mounted centered inside said housing in an axial direction to be extendable/contractible in a vertical direction;

a drive mechanism in said housing for extending/contracting said ram in a vertical direction;

said housing includes a cylindrical shaft portion protruding from a lower part of a side surface of said housing;

said drive mechanism includes a drive gear pivotally and rotatably supported in said cylindrical shaft portion;

said housing is made up of a plurality of housing pieces;

said housing pieces are vertically divided portions of said housing; a plurality of leg portions which allow said vertical housing to be separated from said base and means for mechanically joining said housing pieces to form said housing.

2. A jack for automobile according to claim 1, wherein:

said housing pieces are divided in the vertical direction, with a division passing through an axis position of said cylindrical shaft portion.

3. A jack for automobile according to claim 2, wherein:

said cylindrical shaft portion is integrally formed with said housing pieces.

4. A jack for automobile according to claim 3, wherein:

one of a bush and a bearing layer is interposed between an inner circumferential surface of said cylindrical shaft portion and a shaft portion of said drive gear.

5. A jack for automobile according to claim 2, wherein said housing is divided in a vertical direction into a pair of housing pieces, and said pair of housing pieces are symmetrical.

6. A jack for automobile according to claim 2, wherein:

one of a bush and a bearing layer is interposed between an inner circumferential surface of said cylindrical shaft portion and a shaft portion of said drive gear.

7. A jack for automobile according to claim 1, wherein:

each of said housing pieces includes joining pieces extending from edge portions of said housing pieces; and means for permitting joining together said housing pieces to form one housing using rivets.

8. A jack for automobile, according to claim 1, wherein said housing includes:

joining pieces along edge portions of each of said housing portions;

said joining pieces extending from said edge portions;

connecting piece extending from at least one of said joining pieces; and said connecting piece being folded to overlap and thereby mechanically fix said joining pieces to each other.

9. A jack for automobile according to claim 1, wherein:

said housing includes a leg piece protruding from a lower end portion of said housing; and said leg piece is riveted to said base.

10. A jack for automobile according to claim 1, wherein:

said ram includes a cylindrical portion and a ram nut;

a circumferential groove is formed around an outer circumference of an inserting portion of said ram nut which is to be inserted in said cylindrical portion; and after said inserting portion is inserted into said cylindrical portion, an inner surface of said cylindrical portion is bulged out and fixably fitted in said circumferential groove by caulking an outer circumferential portion of said cylindrical portion.

11. A screw-type jack for automobile, comprising:

a base;

a hollow and integrated housing standing on said base;

a ram guide in a center portion inside said housing in an axial direction to be extendable/contractible in a vertical direction;

a ram mounted in said ram guide to be extendable/contractible;

a screw shaft for extending/contracting said ram guide and said ram in said vertical direction;

said housing includes a cylindrical shaft portion protruding from a lower portion of a side surface of said housing;

a drive gear is pivotally and rotatably supported in said cylindrical shaft portion;

said housing is a plurality of housing pieces which are vertically divided portions of said housing; a plurality of leg portions which allow said vertical housing to be separated from said base and said plurality of housing pieces are mechanically joined with each other to form one housing.

12. A screw-type jack for automobile, comprising:

a base;

a housing standing on said base;

a ram mounted in a center portion inside said housing in an axial direction to be extendable/contractible in a vertical direction;

a drive mechanism mounted in said housing for extending/contracting said ram in said vertical direction;

said housing includes a cylindrical shaft portion protruding from a lower part of a side surface of said housing;

said drive mechanism includes a drive gear pivotally and rotatably supported in said cylindrical shaft portion;

a spacer ring attached between a handle joint of an operation handle and a portion of said shaft portion corresponding to an end portion of an outer surface of said cylindrical shaft portion; and said handle joint being attached to said shaft portion of said drive gear to swing freely via a pin.

* * * * *